US005173699A

United States Patent [19]

Barr et al.

[11] Patent Number: 5,173,699

[45] Date of Patent: Dec. 22, 1992

[54] ANTENNA ARRANGEMENT

[75] Inventors: Andrew D. Barr, St. Albans; Stephen J. Woodhouse, Bushey, both of England

[73] Assignee: The Marconi Company Limited, United Kingdom

[21] Appl. No.: 129,437

[22] Filed: Nov. 5, 1987

[30] Foreign Application Priority Data

Nov. 14, 1986 [GB] United Kingdom ..... 8627333

[51] Int. Cl.[5] ..... H01Q 17/00

[52] U.S. Cl. ..... 342/2; 343/872

[58] Field of Search ..... 342/1, 2; 343/872

[56] References Cited

U.S. PATENT DOCUMENTS 4,173,187 11/1979 Steverding ..... 102/105
4,358,772 11/1982 Leggett ..... 343/872
4,700,190 10/1987 Harrington ..... 342/2

FOREIGN PATENT DOCUMENTS 568101 8/1977 U.S.S.R. ..... 343/872

*Primary Examiner*—Theodore M. Blum
*Attorney, Agent, or Firm*—Kirschstein, Ottinger, Israel & Schiffmiller

[57] ABSTRACT

A missile radome (1) has an acutely pointed profile and includes an antenna array of four elements (A, B) toe'd out around the boresight (5) for an amplitude comparison system. Certain received signals strike the antenna elements (A & B) after grazing the internal radome surface, and after single multiple reflections. The tracking characteristic consequently suffers perturbations. A layer (6) of surface wave absorbent material is provided on the inside of the radome (1) in combination with a mass of radar absorbent material (7) enclosed by this layer. The combination considerably improves the position.

3 Claims, 3 Drawing Sheets

ANTENNA ARRANGEMENT

BACKGROUND OF THE INVENTION

1. Field of the Invention

This invention relates to antenna arrangements and particularly to radar antennas mounted within radomes.

2. Description of Related Art

Target seeking missiles incorporating such arrangements are generally required to operate at high speed, when aerodynamic considerations demand a high fineness ratio radome profile, i.e., an acutely pointed profile as shown in FIG. 1 of the accompanying drawings.

At relatively small angles off the antenna boresight, which is assumed aligned with the missile longitudinal axis, target signals passing through the radome will have a high incidence angle at the inside surface of the opposite wall and a significant proportion of the incident energy will be reflected. The reflected signal may intercept the antenna which will then be receiving signals both direct and after reflection. A wide beamwidth antenna, which is desirable in such systems, will detect both signals and the interference between them will result in a degradation of the radiation patterns.

The antenna assembly may comprise pairs of antenna elements for tracking a target in azimuth and elevation. As a result of the above degradation, the tracking response of a pair of antennas will suffer perturbation to the desired monotonic (within the operating field of view), and approximately linear, difference characteristic. Minor perturbations are manifested as ripples on the tracking response which cause a localised tracking error; major perturbations result in a reversal of the slope of the tracking curve (difference characteristic) and lead to ambiguous target bearing information.

The above problem is one of several which are exacerbated by the use of acutely pointed radomes but which may occur to a lesser extent with more traditional, continuous profile radomes. Amongst these problems are the following:

1. Direct reflection from the internal wall of the radome—as discussed above.
2. Multiple reflections between the antenna and the radome wall.
3. Surface wave effects along the radome wall with signals close to grazing incidence.
4. Scattering and coupling between antenna elements.

SUMMARY OF THE INVENTION

Accordingly, an object of the invention is to alleviate one or more of the above problems.

According to the present invention, in an antenna arrangement comprising an antenna assembly mounted within a radome, the radome inner wall is fitted with surface wave absorbent material and the remaining space between the antenna assembly and the radome is at least partly filled with radar absorbent material, the arrangement being such as to at least partly suppress radar signals reaching the antenna assembly by other than direct path through the radome. The surface wave absorbent material preferably forms a shell conforming to the inner wall of the radome.

The radome may be acutely pointed and the antenna assembly may comprise a plurality of antenna elements uniformly distributed around the assembly boresight, each antenna element being directed forwardly at an angle to the boresight.

BRIEF DESCRIPTION OF THE DRAWING

An antenna arrangement according to the present invention will now be described, by way of example, with reference to the accompanying drawings, of which:

FIG. 2(*b*) is the corresponding difference characteristic or tracking curve;

DETAILED DESCRIPTION OF THE PREFERRED EMBODIMENTS

Figure 1:
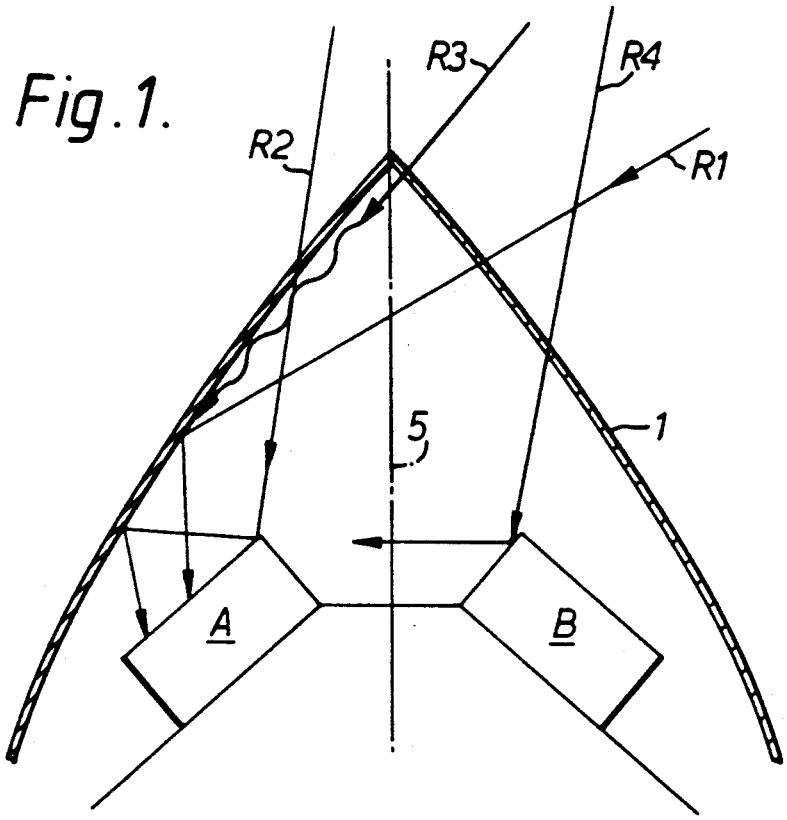
FIG. 1 is a diagrammatic sectional elevation of a known high speed radome housing orthogonal pairs of antenna elements and showing a selection of incident rays.

Referring to FIG. 1 of the drawings, this shows a radome 1 forming the forward end of a missile (not shown) and having an acutely pointed profile suitable for high speed operation. Antenna elements A & B are two of four in a uniformly distributed array around the boresight (5), which coincides with the missile axis.

The elements A & B may cover, say, azimuth tracking of a target, the other pair, not shown, then covering tracking in elevation. The antenna elements each comprise a broad-band cavity-backed spiral antenna, the four elements being mounted on a pyramidal ground plane 3.

Figure 2A:
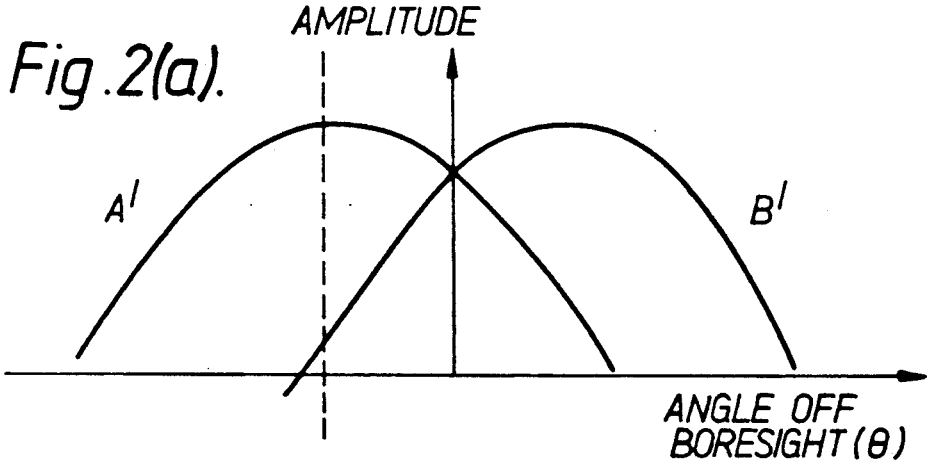
FIG. 2(*a*) is an ideal characteristic for one pair of the antenna elements, of received signal amplitude against angle off boresight.
Figure 2B:
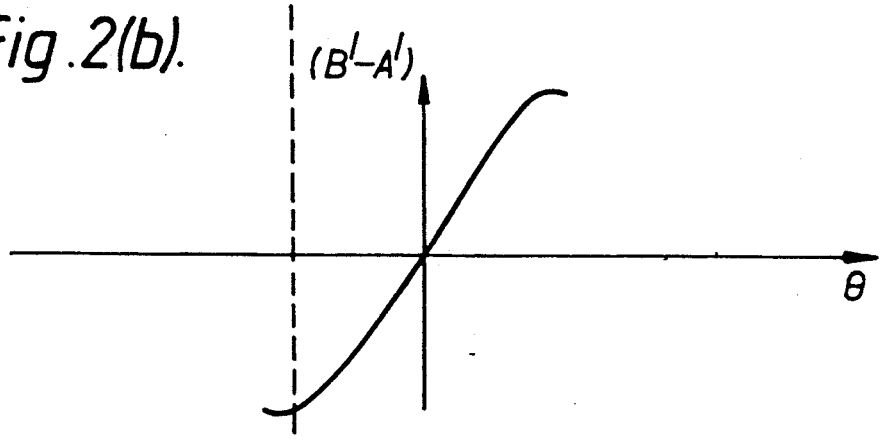

Since the elements A & B are directed forwardly but at an angle to the boresight, their individual characteristics A' & B' are displaced relatively, as shown in FIG. 2(*a*). It may also be noted that the individual elements have wide beamwidths. The resulting difference signal is shown in FIG. 2(*b*), the required shape of this tracking curve being essentially monotonic and preferably linear within the field of view between the individual element peaks.

FIG. 1 shows several incident rays which can produce problems. Ray R1 passes through one wall of the radome at such an angle and position that it would ideally not be intercepted by an antenna element. It is, however, reflected off the internal opposite wall of the radome onto the element A.

A ray R2 is properly received on a direct path by the element A but is then at least partially reflected to the radome wall and re-reflected on to the same element A.

Ray R3 enters the radome at grazing incidence to the internal radome surface and the resulting surface wave produces scattering on to the adjacent antenna element, consequent signal interference, and degraded performance.

Ray R4 is incident directly on to element B but is partially scattered and coupled to the other elements. Again interference and degraded performance result.

Figure 3:
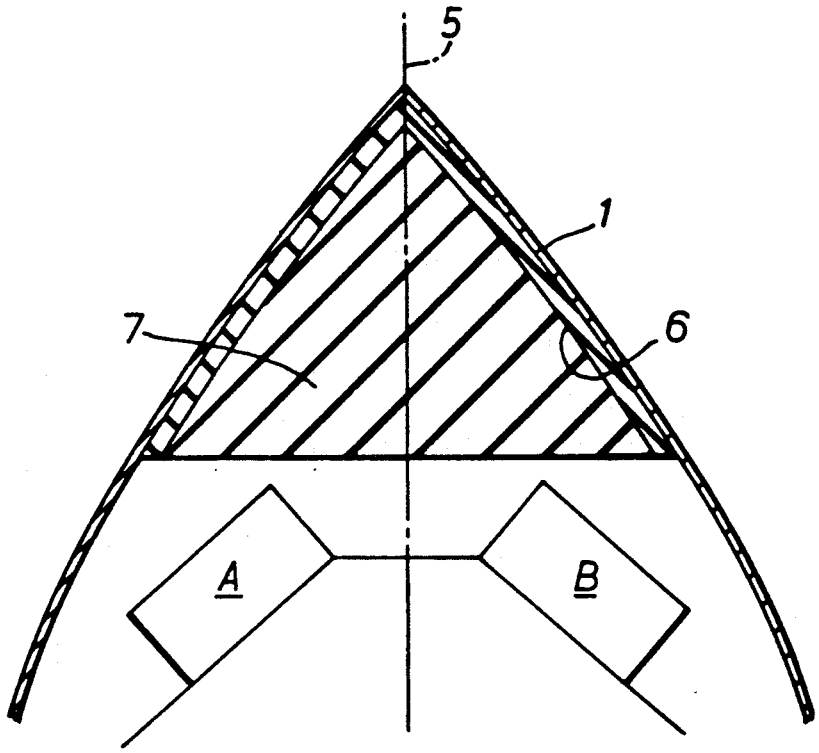
FIG. 3 shows a sectional view of the antenna assembly incorporating features according to the invention.

FIG. 3 is similar to FIG. 1 but incorporating the invention. A cone of surface wave absorbent material ("SWAM") 6 is fitted conformally to the inside of the radome by adhesive or by mechanical force urging or wedging it into the apex of the radome. The 'SWAM' may for example be Plessey Type No. X/79/0407/000 of thickness 1.65±0.1 mm. The remaining space above the antenna elements is filled with 'radar-absorbent-material' ("RAM") 7, for example, Emerson & Cuming (UK) Ltd., Eccosorb AN73.

The combination of SWAM & RAM is optimised for the particular frequencies of interest by adjustment of the thickness of the layer 6 and the particular grade of the material.

Figure 4:
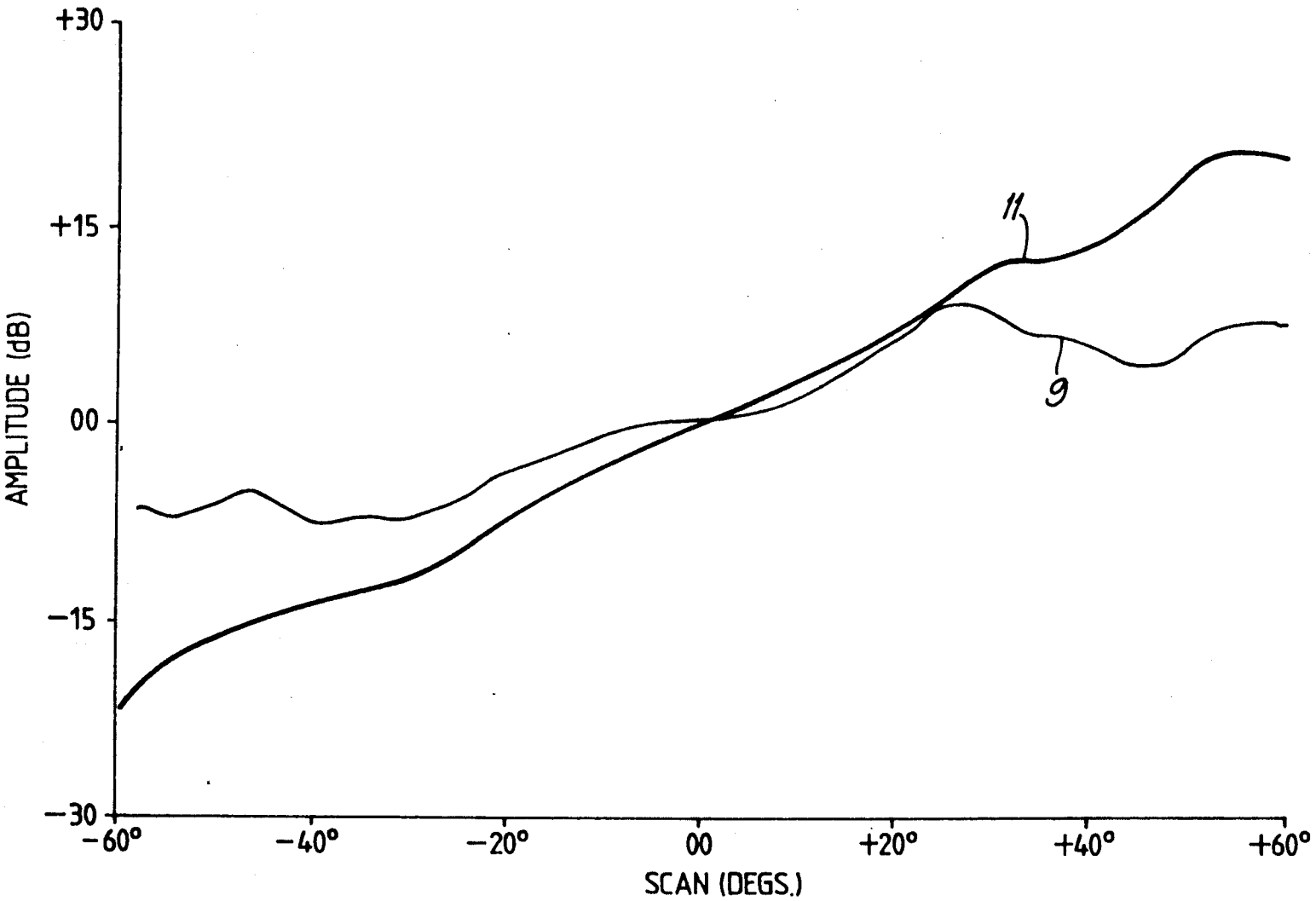
FIG. 4 shows an example of a tracking curve before and after modification of the assembly according to the invention.

FIG. 4 shows the improvement provided in a particular example. The curve 9 is the difference curve, i.e. corresponding to the centre part of FIG. 2(*b*), for an unmodified antenna assembly, while curve 11 is the improved version for the same radome using the combination of SWAM & RAM.

While the invention is intended primarily for use with high speed missile seekers having acutely pointed 'front ends', significant improvements can be obtained for antenna/radome equipments in other situations where the above problems of the prior art schemes are not so damaging.

We claim:

1. An antenna arrangement for suppressing indirectly received radar signals, comprising a radome, an assembly of antenna elements mounted within said radome, a boresight of said assembly of antenna elements said boresight extending symmetrically through said radome and defining a forward direction, a layer of surface wave absorbent material on the inner surface of said radome forward of said antenna elements, and a body of radar absorbent material within said layer of surface wave absorbent material forward of said antenna elements.

2. An antenna arrangement according to claim 1, wherein said radome is an acutely pointed missile radome and said antenna elements are uniformly distributed around said boresight.

3. An antenna arrangement according to claim 2, wherein said layer of surface wave absorbent material forms a shell conforming to said inner surface of said radome, said shell being filled by said radar absorbent material.

* * * * *